US010059131B2

(12) United States Patent
Sumioka et al.

(10) Patent No.: US 10,059,131 B2
(45) Date of Patent: Aug. 28, 2018

(54) SHEET FEEDING APPARATUS AND PRINT APPARATUS

(71) Applicant: CANON KABUSHIKI KAISHA, Tokyo (JP)

(72) Inventors: Masaki Sumioka, Yokohama (JP); Toshiaki Yamaguchi, Machida (JP); Ryo Kobayashi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 618 days.

(21) Appl. No.: 14/702,963

(22) Filed: May 4, 2015

(65) Prior Publication Data

US 2015/0328906 A1 Nov. 19, 2015

(30) Foreign Application Priority Data

May 15, 2014 (JP) ..... 2014-101623

(51) Int. Cl.

| | |
|---|---|
| ***B41J 11/04*** | (2006.01) |
| ***B65H 16/02*** | (2006.01) |
| ***B65H 16/10*** | (2006.01) |
| ***B41J 15/04*** | (2006.01) |
| ***B65H 16/08*** | (2006.01) |

(52) U.S. Cl.

CPC ..... *B41J 15/042* (2013.01); *B41J 11/04* (2013.01); *B65H 16/02* (2013.01); *B65H 16/08* (2013.01); *B65H 16/106* (2013.01); *B65H 2301/41376* (2013.01); *B65H 2801/36* (2013.01)

(58) Field of Classification Search

CPC ..... B41J 15/042; B41J 11/04; B65H 16/08; B65H 16/106; B65H 16/02; B65H 2801/36; B65H 2301/41376

See application file for complete search history.

(56) References Cited

U.S. PATENT DOCUMENTS

| | | | | |
|---|---|---|---|---|
| 5,758,982 | A | 6/1998 | Yoshida et al. | |
| 7,507,045 | B1 * | 3/2009 | Harris | B41J 11/0075 242/595.1 |
| 7,549,814 | B1 * | 6/2009 | Arrington | B65H 26/08 242/595.1 |

(Continued)

FOREIGN PATENT DOCUMENTS

| | | |
|---|---|---|
| CN | 1131614 A | 9/1996 |
| CN | 1583308 A | 2/2005 |
| CN | 201495369 U | 6/2010 |

(Continued)

OTHER PUBLICATIONS

Chinese Office Action issued in corresponding Chinese Application No. 201510241174.1 dated May 27, 2017.

(Continued)

*Primary Examiner* — William A. Rivera
(74) *Attorney, Agent, or Firm* — Fitzpatrick, Cella, Harper & Scinto

(57) ABSTRACT

A sheet feeding apparatus is provided which restrains a borne rolled sheet from being deflected to allow the sheet to be reliably fed. The sheet feeding apparatus includes a holder configured to hold the rolled sheet so as to be rotated; and a rotator configured to bear an outer periphery of the rolled sheet held by the holder from below in a direction of gravity, the rotator rotating with the rolled sheet while feeding.

9 Claims, 11 Drawing Sheets

(56) References Cited

U.S. PATENT DOCUMENTS

| | | | | |
|---|---|---|---|---|
| 8,322,644 | B2 * | 12/2012 | Nakada | B65H 16/10 242/394.1 |
| 2006/0157526 | A1 * | 7/2006 | Shiraishi | B65H 16/02 226/169 |

FOREIGN PATENT DOCUMENTS

| | | | |
|---|---|---|---|
| CN | 102343728 | A | 2/2012 |
| CN | 103097049 | A | 5/2013 |
| CN | 103221312 | A | 7/2013 |
| JP | 62-230549 | A | 10/1987 |
| JP | 2001-163495 | A | 6/2001 |
| JP | 2006-232549 | A | 9/2006 |
| JP | 2006-289887 | A | 10/2006 |
| JP | 2006-306511 | A | 11/2006 |
| JP | 2013-158973 | A | 8/2013 |

OTHER PUBLICATIONS

Office Action dated Feb. 13, 2018, in Chinese Patent Application No. 201510241174.1.
Office Action dated Apr. 3, 2018 in Japanese Patent Application No. 2014-101623.

* cited by examiner

CONTACT FORCE TABLE

| SHEET TYPE | CONTACT FORCE |
|---|---|
| PLAIN PAPER, GLOSSY PAPER (DEF), COATED PAPER | STANDARD |
| PAPER SUSCEPTIBLE TO DAMAGE | WEAK |
| HIGH-RIGIDITY PAPER (ART PAPER), HIGH-BASIC-WEIGHT PAPER | STRONG |

FIG.8

SHEET FEEDING APPARATUS AND PRINT APPARATUS

BACKGROUND OF THE INVENTION

Field of the Invention

The present invention relates to a sheet feeding apparatus and a print apparatus in which a sheet is pulled out from a rolled sheet and fed.

Description of the Related Art

Print apparatuses are known in which a web-like sheet is pulled out from a rolled sheet and fed. Japanese Patent Laid-Open No. 2001-163495 discloses a configuration of a sheet feeding apparatus in which engagement portions are attached to respective opposite ends of a paper tube and rotatably held by two holders in a print apparatus.

In the apparatus in Japanese Patent Laid-Open No. 2001-163495, the weight of the rolled sheet is borne via the engagement portions attached to the respective opposite ends of the paper tube of the roll. In other words, the weight of the roll is borne only at the opposite ends of the roll, and nothing bears the weight of the roll near the center of the roll. Normally, to prevent the roll from being deflected (warped downward in the direction of gravity) under the weight thereof in spite of the manner of weight bearing, the paper tube and the rolled sheet rolled around the paper tube are provided with sufficient rigidity. However, for a larger sheet width (for example, several m) handled by large-format printers, a thicker and heavier paper tube needs to be used in order to provide the roll with sufficient rigidity. This increases the weight of the roll as a whole to affect handling during installation and transportation. Furthermore, an increased weight of the roll causes components bearing the roll at the opposite ends thereof to be worn off earlier, thus shortening the lives of the components.

However, a reduced weight of the rolled sheet (paper tube) decreases the rigidity of the roll to increase the fear that the vicinity of center of the roll is deflected downward in the direction of gravity under the weight of the roll when the roll is borne at the two, opposite ends thereof. Such deflection of the roll causes wrinkles or folds in the sheet pulled out from the roll. Printing the areas of the wrinkles or folds leads to inappropriate images.

An aspect of the present invention provides a sheet feeding apparatus that restrains the borne rolled sheet from being deflected to allow the sheet to be reliably fed.

SUMMARY OF THE INVENTION

According to a first aspect of the present invention, a sheet feeding apparatus includes a holder configured to hold a rolled sheet so as to be rotated; and a rotator configured to bear an outer periphery of the rolled sheet held by the holder from below in a direction of gravity, the rotator rotates with the rolled sheet while feeding.

According to a second aspect of the present invention, a print apparatus includes the sheet feeding apparatus, wherein an image is printed on a sheet fed from the sheet feeding apparatus.

In this configuration, a rotator is held in contact with the outer periphery of the rolled sheet from below in the direction of gravity to bear the weight of the rolled sheet in a distributive manner. Thus, the borne rolled sheet can be restrained from being deflected. This prevents a pulled-out sheet from being wrinkled or folded.

Further features of the present invention will become apparent from the following description of exemplary embodiments (with reference to the attached drawings).

BRIEF DESCRIPTION OF THE DRAWINGS

FIG. 8 is a table depicting an example of a table used to specify a contact position;

DESCRIPTION OF THE EMBODIMENTS

Embodiments of the present invention will be described below with reference to the drawings.

First Embodiment

Figure 1:
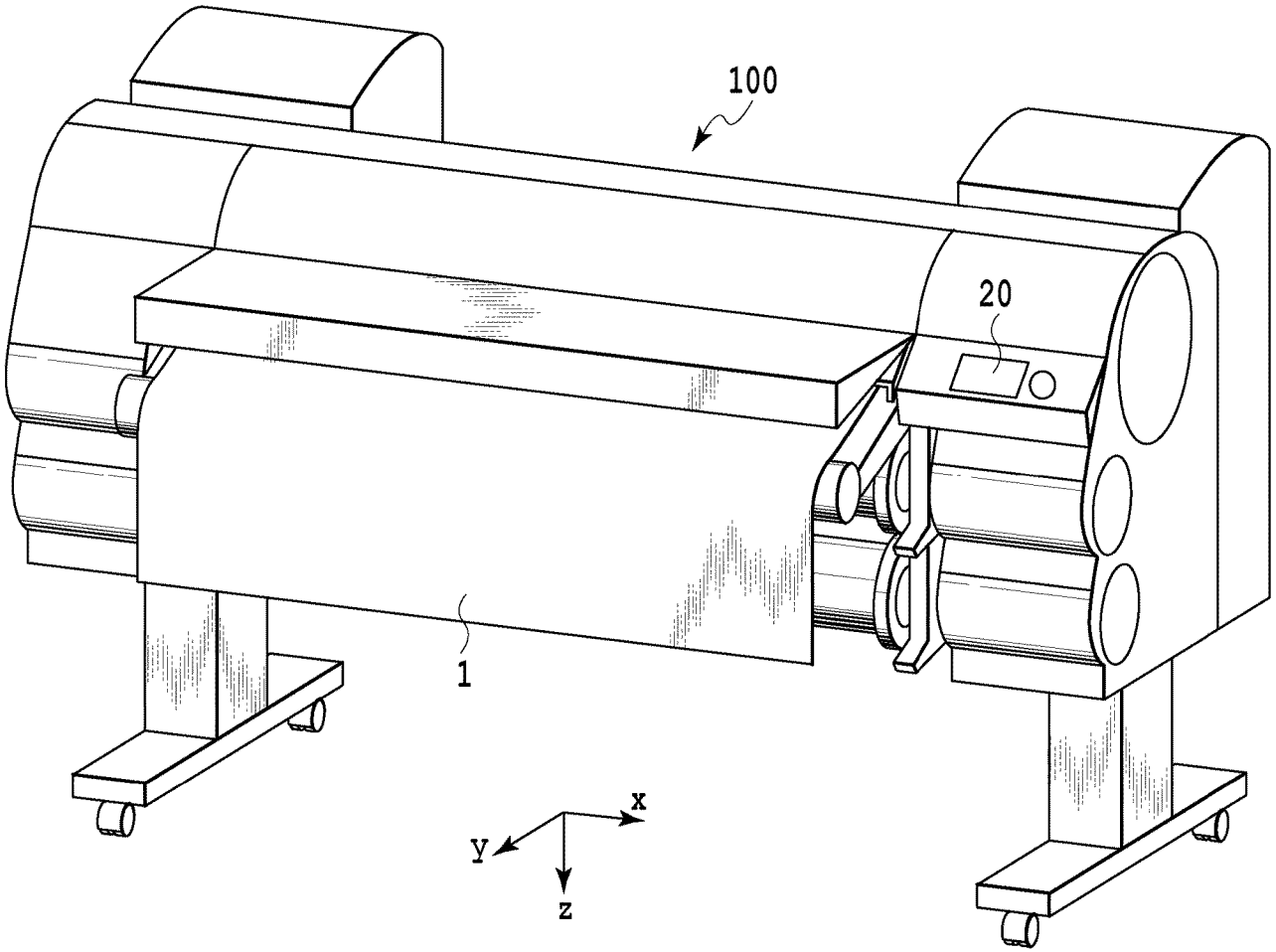
FIG. 1 is a perspective view depicting the appearance of a print apparatus.

FIG. 1 is a perspective view depicting the appearance of a print apparatus 100. Two rolls of sheets in the form of rolled sheets are set in the print apparatus 100. The print apparatus 100 is configured to pull out a sheet from one of the rolls of sheets and print an image on the pulled-out sheet. A user uses various switches provided on an operation panel 20 to input various commands for the print apparatus 100 such as size specification for a sheet 1 and switching between online and offline.

Figure 2:
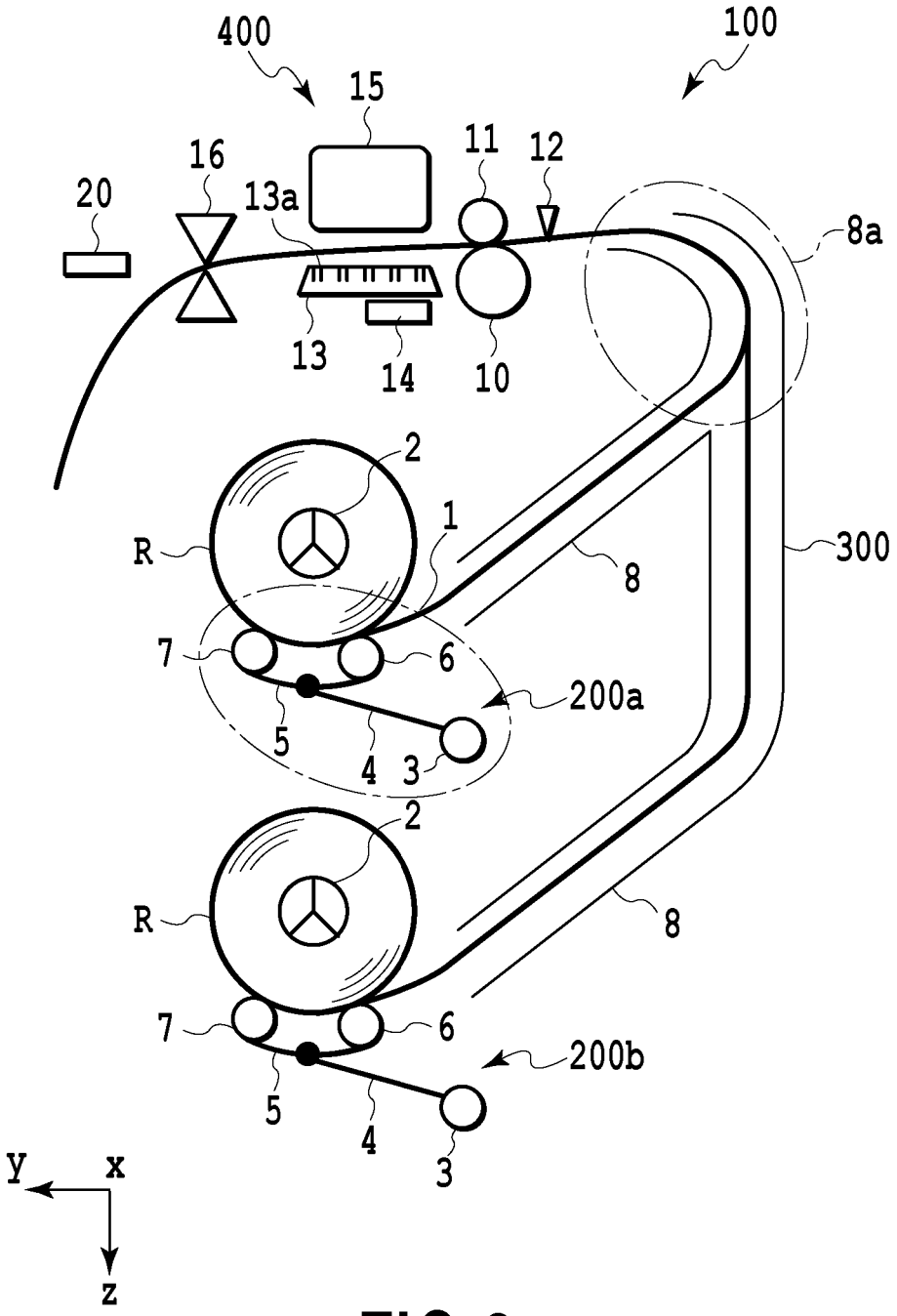
FIG. 2 is a schematic cross-sectional view depicting an internal configuration of the print apparatus.

FIG. 2 is a schematic cross-sectional view depicting an internal configuration of the print apparatus 100. As depicted in FIG. 2, the print apparatus 100 includes sheet feeding units (feeding units or sheet feeding apparatuses) 200*a* and 200*b*, a conveying unit 300, and a print unit 400.

The sheet feeding units 200*a* and 200*b* pull the sheet 1 out from a rolled sheet R (a roll of web-like sheet), guide the sheet 1 to the conveying unit 300, and feed the sheet 1 to the print unit 400. Specifically, the sheet feeding unit 200*a* feeds the rolled sheet R set on an upstream side in a z direction.

The sheet feeding unit 200*b* feeds the rolled sheet R set on a downstream side in the z direction.

As shown in FIG. 2, each of the sheet feeding units 200*a* and 200*b* includes a spool 2, a rotating shaft 3, an arm member 4, a swinging member 5, a driven rotator 6 (rotator), and a driven rotator 7 (rotator). A spool shaft 21, described below, of the spool 2 is inserted into a hollow core of the rolled sheet R to enable the rolled sheet R to be rotated forward and backward in conjunction with rotation of the spool shaft 21. The driven rotator 6 and the driven rotator 7 (these members are hereinafter also referred to as the "bearing rotators") are rollers arranged below the position of the rolled sheet R in the z direction. The plurality of driven rotators is arranged in a width direction (an x direction in the figures (sheet width direction) of the rolled sheet R. As described below in detail, in the print apparatus 100, the sheet 1 is fed out from the rolled sheet R by rotation of the rolled sheet R and by contact driven rotation of the bearing rotators with an outer periphery of a roll-like portion (roll portion) of the rolled sheet R. A "sheet feeding unit 200" is hereinafter used as a general term for the sheet feeding units 200*a* and 200*b*.

The conveying unit 300 conveys the sheet 1 fed out by the sheet feeding unit 200, to the print unit 400. The conveying unit 300 has a conveying guide 8 that leads the sheet 1 to the print unit 400 while guiding opposite surfaces of the sheet 1. An area 8*a* (shown by an alternate long and short dash line in the figures) of the conveying guide 8 which is in proximity to the print unit 400 is shaped along the direction of curl of the rolled sheet R. The use of the thus shaped conveying guide 8 allows the sheet 1 to be smoothly conveyed along the direction of curl of the sheet 1.

On an upstream side of the print unit 400 in a y direction, a leading end detecting sensor 12 and a roller pair including a conveying roller 10 and a nip roller 11 are arranged in order from the upstream side in the y direction.

The leading end detecting sensor 12 detects a leading end of the sheet 1. The conveying roller 10 rotates forward and backward depending on a rotating direction of a driving motor 35 described below with reference to FIG. 5. The nip roller 11 is positioned so as to sandwich the sheet 1 between the conveying roller 10 and the nip roller 11. The nip roller 11 can rotate in conjunction with rotation of the conveying roller 10. Furthermore, the nip roller 11 is moved up and down in the z direction by a separation motor not shown in the drawings to allow the distance between the nip roller 11 and the conveying roller 10 to be adjusted. This enables a nip force to be adjusted.

When the leading end detecting sensor 12 detects a leading end of the sheet 1, a CPU 201 (control unit) described below with reference to FIG. 5 controls the driving motor 35 to rotate the conveying roller 10. The sheet 1 is sandwiched between the conveying roller 10 and the nip roller 11 and conveyed to the print unit 400 by rotation of the conveying roller 10 and rotation of the nip roller 11 occurring in conjunction with rotation of the conveying roller 10. The rotation speed of the conveying roller 10 is increased above the rotation speed of the spool shaft 21 described below with reference to FIG. 3 to apply back tension to the sheet 1 to tense the sheet 1 during conveyance. This prevents the sheet 1 from being deflected and also prevents folds in the sheet or sheet conveying errors.

The print unit 400 has a print head 15. A surface (ejection port surface) of the print head 15 which is opposite to the sheet 1 has ejection ports. Ink is applied to the conveyed sheet 1 by being ejected through the ejection ports, thus printing an image on the sheet 1. A platen 13 is positioned so as to sandwich the sheet 1 between the platen 13 and the ejection port surface, and has a bearing surface that bears the sheet 1. Suction ports 13*a* are formed on a support surface of the platen 13. A suction fan 14 that allows air to be sucked through the suction ports 13*a* is arranged below the position of the platen 13 in the z direction. When the sheet 1 is positioned in a space between the print head 15 and the platen 13, the suction fan 14 is actuated to suck air through the suction ports 13*a* to bring the sheet 1 into tight contact with the platen 13. Thus, the sheet 1 is prevented from coming into contact with the ejection port surface of the print head 15.

A cutter 16 is positioned on a downstream side of the position of the print unit 400 in the y direction. The cutter 16 cuts the sheet 1 printed by the print unit 400. The cut sheet 1 is discharged. The above-described operations are controlled by the CPU 201.

Figure 3A:
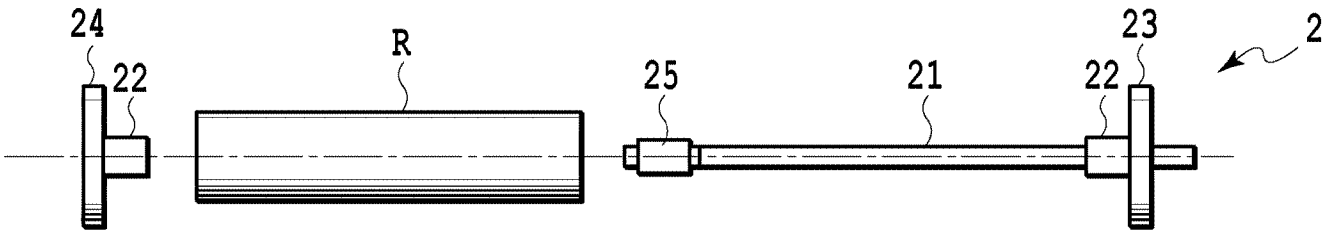
FIG. 3A is a diagram illustrating a method for setting a rolled sheet.
Figure 3B:
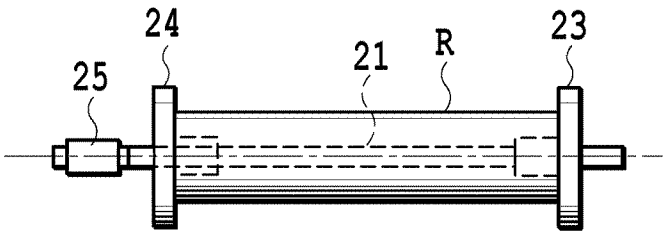
FIG. 3B is a diagram illustrating the method for setting a rolled sheet.
Figure 3C:
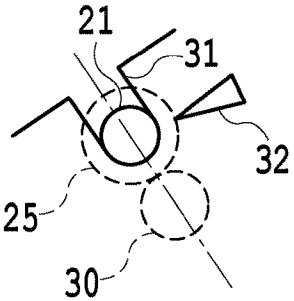
FIG. 3C is a diagram illustrating the method for setting a rolled sheet.

FIGS. 3A to 3C are diagrams illustrating a method for setting the rolled sheet R over the spool 2 that is a bearing unit. The spool 2 has the spool shaft 21, a friction portion 22, a spool flange 23 of a reference side, a spool flange 24 of a non-reference side, and a spool rotating gear 25. As shown in FIG. 3A, the spool flange 23 is arranged at one end of the spool shaft 21. The friction portion 22 is provided inside the spool flange 23. Furthermore, the spool rotating gear 25 that allows the spool shaft 21 to rotate is attached to the other end of the spool shaft 21. The diameter of the hollow core of the rolled sheet R is made larger than the outer diameter of the spool shaft 21 to allow the hollow core of the rolled sheet R to be relatively easily fitted over the spool shaft 21.

When the rolled sheet R is set on the spool 2, first, the spool flange 24 fitted over the spool shaft 21 is removed. The spool shaft 21 is passed through the hollow core of the rolled sheet R. The hollow core of the rolled sheet R is fitted over the friction portion 22 up to a position where a side portion of the rolled sheet R comes into contact with the spool flange 23. Then, the spool flange 24 is passed over the spool shaft 21. The friction portion 22 provided inside the spool flange 24 is fitted into the hollow core of the rolled sheet R to fix the position of the spool flange 24. The friction portion 22 cuts into an inner surface of the hollow core under a radial elastic force. The rolled sheet R is thus fixedly held by the spool 2 and rotated in conjunction with rotation of the spool shaft 21.

When the spool 2 is attached to the rolled sheet R at the opposite ends thereof, the rolled sheet R is set over the spool 2 and integrated with the spool 2 as shown in FIG. 3B.

FIG. 3C is a side view depicting that the spool 2 is held by a spool holder 31 provided in the print apparatus 100 main body. The print apparatus 100 is provided with a spool holder 31 that is a holder holding the spool 2. To allow the spool 2 to be arranged at a desired position in the print apparatus 100, the spool holder 31 is provided at a position corresponding to the spool flange 23 and at a position corresponding to the spool flange 24. The spool holder 31 has a cross unit shaped generally like the character U in a front view. The spool holder 31 has an opening that is open upward in the z direction and allows the spool shaft 21 to be fitted into the spool holder 31 through the opening. The user lowers the spool 2 obliquely downward from above to below in the z direction to set the spool 2 in the spool holder 31.

With the spool shaft 21 fitted in the spool holder 31, a spool driving gear 30 is arranged at a position where the spool driving gear 30 engages with the spool rotating gear 25. A spool driving motor 34 (driving unit) described below with reference to FIG. 5 drives and rotates the spool driving gear 30, and the rotation is transmitted from the spool driving gear 30 to the spool rotating gear 25, which thus rotates to rotate the spool shaft 21. The rotation of the spool shaft 21 causes the rolled sheet R borne by the spool 2 to be also rotated, allowing the sheet 1 to be fed from the sheet feeding unit 200. Furthermore, the sheet 1 can be taken up by rotating the rolled sheet R in a direction opposite to the sheet feeding direction.

A sheet detecting sensor 32 detects the presence or absence of the rolled sheet R. Thus, the sheet detecting sensor 32 is positioned so as to be able to detect the sheet 1 while the spool 2 is arranged in the spool holder 31, as shown in FIG. 3C.

As described above, the rolled sheet R integrated with the spool 2 is placed in the spool holder 31 provided in the print apparatus 100 and thus set in the print apparatus 100. The bearing rotators are arranged below the position of the spool holder 31 in the z direction at positions where, when the rolled sheet R is set, the bearing rotators do not hinder an operation for setting the rolled sheet R.

Figure 4A:
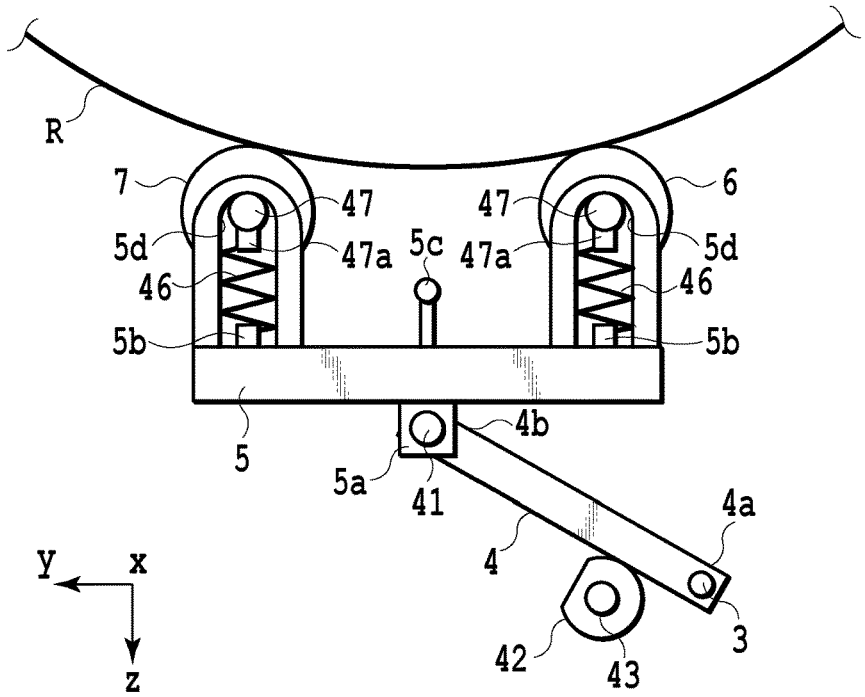
FIG. 4A is a diagram illustrating a configuration of bearing rotators.
Figure 4B:
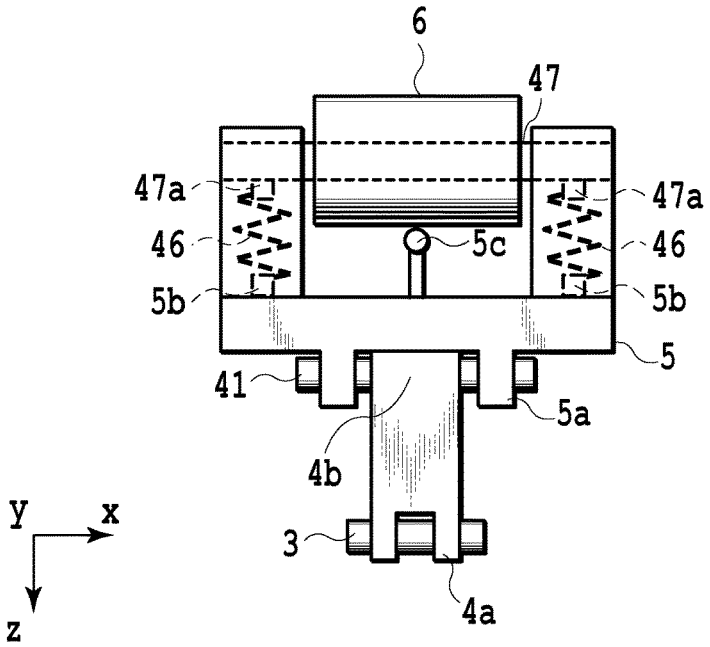
FIG. 4B is a diagram illustrating the configuration of the bearing rotators.

FIGS. 4A and 4B are diagrams illustrating a configuration of the driven rotator 6 and the driven rotator 7 (bearing rotators). FIG. 4A is an enlarged cross-sectional view of a dashed area shown in FIG. 2. FIG. 4B is a diagram depicting the bearing rotators depicted in FIG. 4A as viewed from a downstream side in a sheet feeding direction.

The rotating shaft 3 shown in FIGS. 4A and 4B is rotatably attached to the print apparatus 100 main body and restricted at opposite ends of the rotating shaft 3 in a thrust direction by ring members not shown in the drawings. The rotating shaft 3 engages with an engagement portion 4*a* that is one end of the arm member 4. An engagement portion 4*b* that is the other end of the arm member 4 engages slidably with a shaft member 41. The shaft member 41 is restricted at opposite ends thereof in the thrust direction by ring members not shown in the drawings. The shaft member 41 is engaged with an engagement portion 5*a* provided at a central position of a swinging member (rotator holder) 5 in the y direction, so as to be able to swing.

As shown in FIG. 4A, a distance sensor 5*c* is arranged on a surface of the swinging member 5 that faces upward in the z direction. In this case, a noncontact reflective sensor is used as the distance sensor 5*c*. However, a contact sensor may be used. In this case, the distance sensor 5*c* is used to determine the positions of the bearing rotators. The distance sensor 5*c* is arranged in a substantially central portion, in the y direction, of the surface of the swinging member 5 that faces upward in the z direction. Fixing portions 5*b* are arranged at respective opposite ends of the swinging member 5 in the y direction which ends are located at an equal distance from the distance sensor 5*c*.

One end of a compression spring (elastic member) 46 is fixed to the fixing portion 5*b*. The other end of the compression spring 46 is fixed to a protruding portion 47*a* of the shaft member 47*b*. The compression spring 46 biases the shaft member 47 from below to above in the z direction. Movement of the shaft member is limited by retainer 5*d*. The driven rotator 6 engages rotatably with the shaft member 47 which is located at a downstream side in the sheet-feeding-direction. The driven rotator 7 engages rotatably with the shaft member 47 which is located at an upstream side with respect to the sheet-feeding-direction. Since the compression spring 46 biases the shaft member 47 from below to above in the z direction, the driven rotator 6 and driven rotator 7 engaged with the shaft member 47 can come into contact with the outer periphery of the rolled sheet R from the lower side to the upper side in the z direction.

The driven rotator 6 and driven rotator 7, held in contact with the rolled sheet R, rotate in conjunction with rotation of the rolled sheet R. The driven rotator 6 and the driven rotator 7 are arranged separately from each other in a direction in which the sheet 1 is pulled out from the rolled sheet R (y direction). The driven rotator 7 is arranged farther from the conveying guide 8 shown in FIG. 2 than the driven rotator 6. While held in contact with the rolled sheet R, the driven rotator 7 bears the rolled sheet R from below (from the downstream side) in the direction of gravity so as not to make the rolled sheet R loose.

As shown in FIG. 4A, the driven rotator 6 and the driven rotator 7 are positioned at an approximately equal distance from the central position of the swinging member 5 in the y direction. In this configuration, the swinging member 5 swings around the shaft member 41 to make the force (contact force) with which the driven rotator 6 comes into contact with the rolled sheet R equal to the force with which the driven rotator 7 comes into contact with the rolled sheet R.

A rotating cam 42 is arranged below the position of the arm member 4 in the z direction. The arm member 4 is positioned by being biased against the rotating cam 42 by the weights of the swinging member 5, the driven rotators 6 and 7, and the like. The rotating cam 42 engages with a shaft member 43.

The shaft member 43 is rotated using a driving motor 33 (driving unit) described below with reference to FIG. 5, to pivot the arm member 4 in conjunction with rotation of the shaft member 43. Thus, the swinging member 5 swings to displace the driven rotator 6 and the driven rotator 7 (bearing rotators). In this case, the bearing rotators are placed at a contact position where the bearing rotators come into contact with the outer periphery of the rolled sheet R or a separate position where the bearing rotators are separated from the outer periphery of the rolled sheet R. Specifically, as described in detail with reference to FIG. 6, the bearing rotators are placed at the contact position for a sheet feeding operation (feeding operation) and at the separate position for a positional-deviation correcting operation.

As described above, the driven rotator 6 and the driven rotator 7 are biased by the compression spring 46 via the shaft member 47 in a direction in which the driven rotators 6 and 7 come into contact with the rolled sheet R. Thus, even when the outer diameter of the rolled sheet R (roll outer diameter) changes, the driven rotator 6 and the driven rotator 7 can be brought into contact with the rolled sheet R by the bias force of the compression spring 46.

The driving motor 33 is controlled by the CPU 201 described below with reference to FIG. 5 to allow the shaft member 43, the rotating cam 42, the arm member 4, the swinging member 5, the compression spring 46, and the shaft member 47 to interact with one another, thus changing the positions of the driven rotator 6 and the driven rotator 7. Thus, these mechanisms are intended to move the driven rotator 6 and the driven rotator 7 and to adjust the force with which the driven rotator 6 and the driven rotator 7 come into contact with the rolled sheet R.

Figure 5:
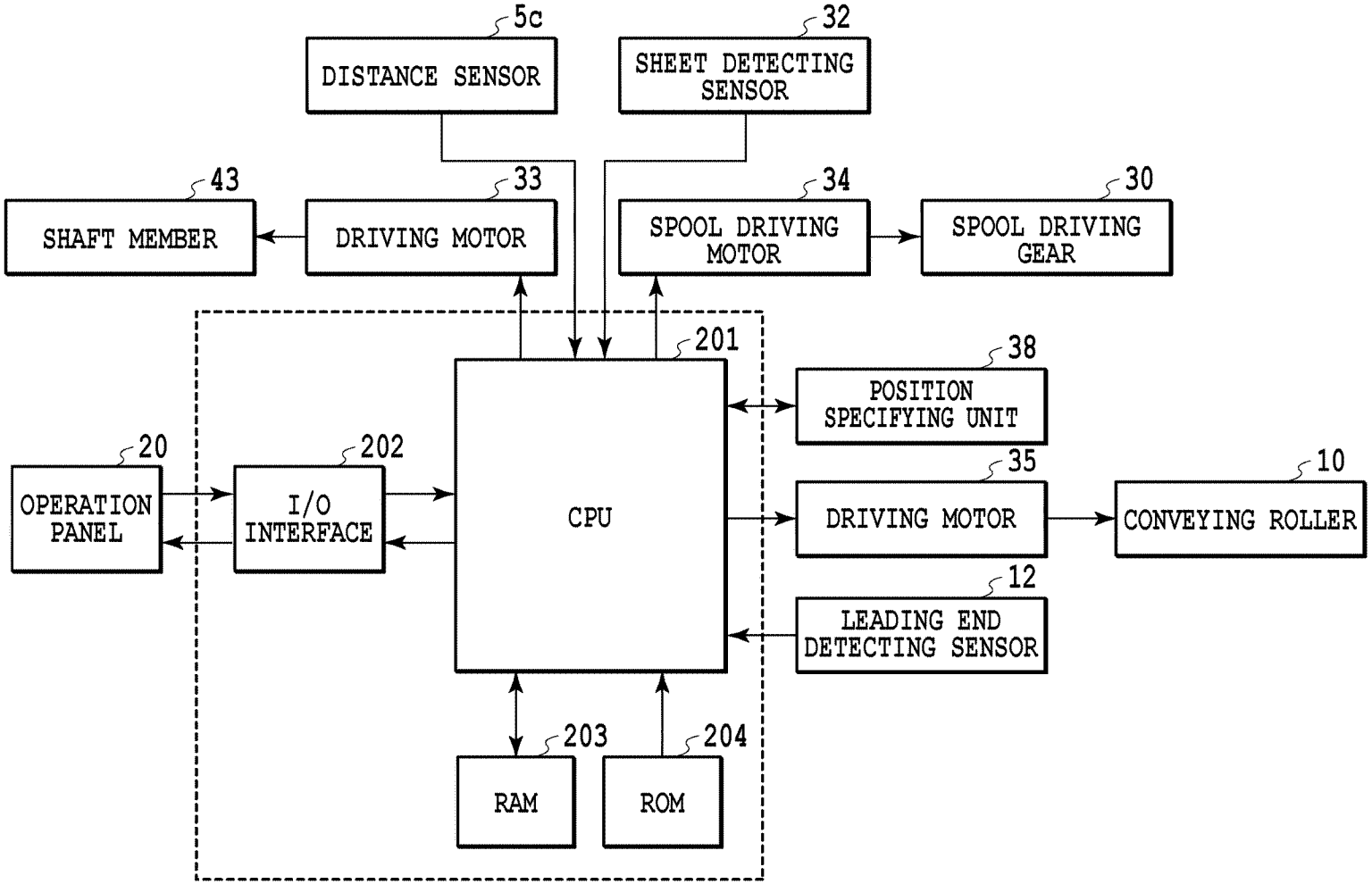
FIG. 5 is a block diagram depicting a control configuration in the print apparatus.

FIG. 5 is a block diagram depicting a control configuration in the print apparatus 100. As shown in FIG. 5, the print apparatus 100 includes the CPU 201, an I/O interface 202, a RAM 203, and a ROM 204. The CPU 201 controls the print apparatus 100 as a whole. The ROM 204 stores various programs executed by the CPU 201 and specific data needed for various operations of the print apparatus 100. The RAM 203 is used as a work area for the CPU 201 or a temporary storage area for various received data. The RAM 203 also stores various setting data.

The user operates the operation panel 20 to input the type of a sheet, the size of the sheet, and various types of setting information. The information is input to the CPU 201 via the I/O interface 202. Furthermore, the CPU 201 displays various types of information on the operation panel 20 via the I/O interface 202. The print apparatus 100 is connected to external device or an external storage medium not shown in the drawings and which inputs image data or the like to the CPU 201 via the I/O interface 202. The CPU 201 executes various processes on the input image data to generate print data, and controls the print apparatus 100 such that the print apparatus 100 prints an image based on the generated print data.

The CPU 201 is connected to the distance sensor 5*c*, the sheet detecting sensor 32, a leading end detecting sensor 12, and a position specifying unit 38. The CPU 201 writes information from these components to the RAM 203 and reads written information from the RAM 203. The position specifying unit 38 specifies the positions of the bearing rotators.

Figure 6:
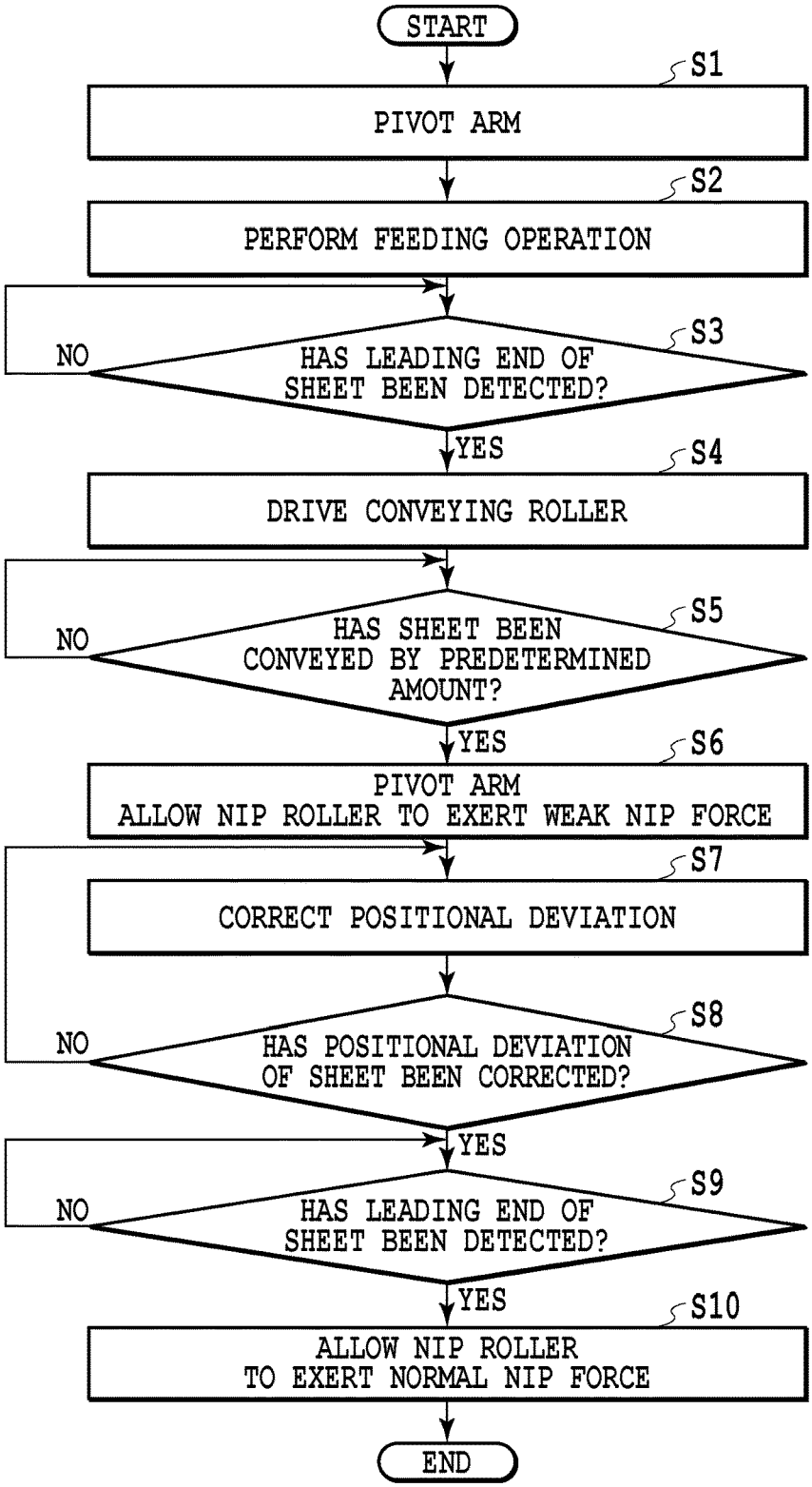
FIG. 6 is a flowchart depicting a flow of a sheet setting operation.

FIG. 6 is a flowchart depicting a flow of a sheet setting operation and illustrating an operation for setting the leading end of the sheet at a position to be set before the start of a print operation.

The spool 2 integrated with the rolled sheet R is set in the spool holder 31 in the print apparatus 100. When the sheet detecting sensor 32 detects the presence of the rolled sheet R, the corresponding information is transmitted from the sheet detecting sensor 32 to the CPU 201. This allows the sheet setting operation to be started. Furthermore, the information such as the type of the rolled sheet R input via the I/O interface 202 to the CPU 201 by the user operating the operation panel 20 is transmitted from the CPU 201 to the position specifying unit 38. The information on the type of the rolled sheet and the like may be acquired by an acquisition unit not shown in the drawings and be input to the CPU 201.

The position specifying unit 38 specifies the positions of the bearing rotators based on the information from the CPU 201. The position specifying unit 38 uses a table described below with reference to FIG. 8 to specify contact positions suitable for the sheet 1 and transmit the corresponding information to the CPU 201.

Based on the information from the position specifying unit 38, the CPU 201 rotates the driving motor 33 forward to rotate the shaft member 43 and thus the rotating cam 42, thus pivoting the arm member 4 (S1). In this case, forward rotation of the driving motor 33 causes the bearing rotators to approach the outer periphery of the rolled sheet R. Backward rotation of the driving motor 33 causes the bearing rotators to leave the rolled sheet R. The distance sensor 5*c* measures the distance between the outer periphery of the rolled sheet R and the bearing rotators and transmits the result to the CPU 201.

The CPU 201 determines the current positions of the bearing rotators based on the measurement result and compares the positions with positions specified by the position specifying unit 38. The CPU 201 controls the driving motor 33 to place the bearing rotators at the appropriate positions. While obtaining the measurement result from the distance sensor 5*c*, the CPU 201 operates the driving motor 33 such that the force exerted on the rolled sheet R by the bearing rotators (the force with which the bearing rotators come into contact with the rolled sheet R) is equal to the desired force, that is, such that the bearing rotators are placed at the specified positions. More specifically, when the force is weaker than the desired force, the driving motor 33 is further rotated forward to exert the desired contact force. On the other hand, when the contact force is stronger than the desired contact force, the driving motor 33 is rotated backward. In this manner, the bearing rotators are placed at the positions where the contact force on the rolled sheet R is equal to the desired contact force.

The method of moving the bearing rotators to the positions specified by the position specifying unit 38 has been described. However, acquiring the contact positions suitable for the sheet from the position specifying unit 38 is not essential. That is, given that the rolled sheet R is set regardless of the type thereof, the bearing rotators may be moved so as to bring the rolled sheet R and each of the bearing rotators into contact with each other. In this case, based on the measurement result from the distance sensor 5*c*, the CPU 201 controls the driving motor 33 so as to bring the bearing rotators into contact with the outer periphery of the rolled sheet R.

Figure 7A:
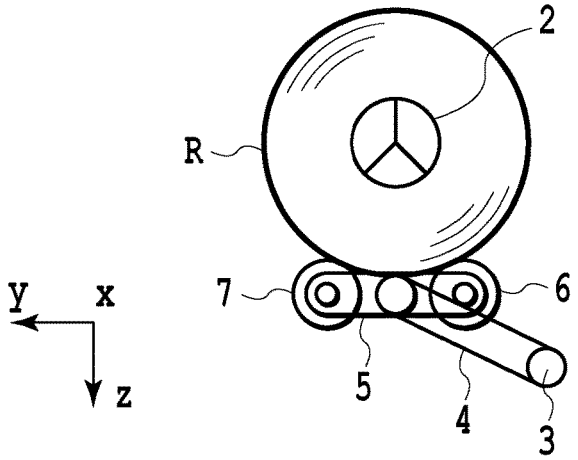
FIG. 7A is a cross-sectional view depicting the bearing rotators and the rolled sheet.
Figure 7B:
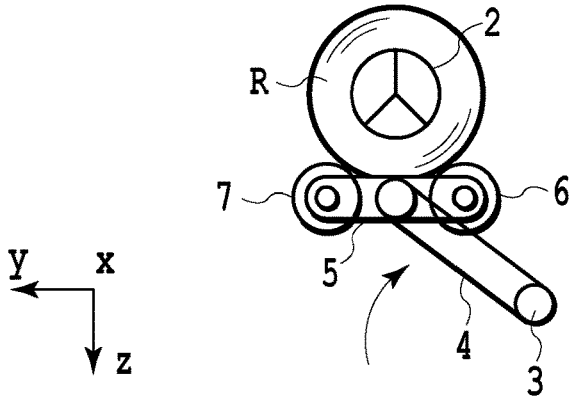
FIG. 7B is a cross-sectional view depicting the bearing rotators and the rolled sheet.
Figure 7C:
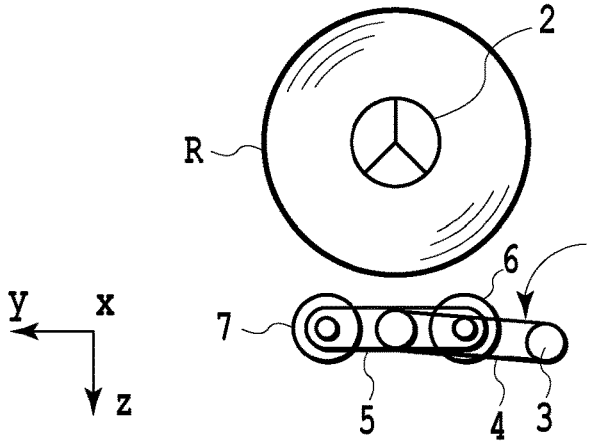
FIG. 7C is a cross-sectional view depicting the bearing rotators and the rolled sheet.

FIGS. 7A to 7C are schematic cross-sectional views depicting the bearing rotators and the rolled sheet R. FIG. 7A depicts a contact state where the roll outer diameter of the rolled sheet R is relatively large. FIG. 7B depicts a contact state where the roll outer diameter of the rolled sheet R is relatively small. Furthermore, FIG. 7C depicts a state where the bearing rotators are separated from the outer periphery of the rolled sheet R to cancel the contact state between the rolled sheet R and the bearing rotators. As depicted in FIGS. 7A and 7B, the positions where the bearing rotators come into contact with the rolled sheet R depend on the size of the roll outer diameter. In order to move the bearing rotators in accordance with a change in roll outer diameter, the CPU 201 operates the driving motor 33 while obtaining the measurement result from the distance sensor 5.

Further description will be given with reference back to FIG. 6. The CPU 201 rotates the spool driving motor 34 forward to rotate the spool shaft 21 via the spool driving gear 30 and the spool rotating gear 25 to allow an operation of feeding the sheet 1 to be started (S2).

When the sheet 1 is fed, the CPU 201 determines whether or not the leading end detecting sensor 12 has detected the leading end of the sheet 1 (S3). When the leading end detecting sensor 12 has not detected the leading end of the sheet 1 (S3, NO), the CPU 201 repeats the determination in S3 until the leading end of the sheet 1 is detected. When the leading end detecting sensor 12 has detected the leading end of the sheet 1 (S3, YES), the CPU 201 rotates the driving motor 35 forward to rotate the conveying roller 10 (S4). Thus, the leading end of the sheet 1 is sandwiched between the conveying roller 10 and the nip roller 11, and conveyed by rotation of this roller pair to pass through the space between the conveying roller 10 and the nip roller 11.

In order to correct a positional deviation of the sheet 1, the CPU 201 determines whether or not the sheet 1 has been conveyed by a predetermined amount (S5). The predetermined amount is an amount at which, during a positional-deviation correcting operation, even when conveyance and take-up of the sheet 1 are repeated, the leading end of the sheet 1 is not positioned on the upstream side of the position of the conveying roller 10 and the nip roller 11 in the y direction. When the sheet 1 has not been conveyed by the predetermined amount (S5, NO), the CPU 201 repeats the determination in S5 until the sheet 1 is conveyed by the predetermined amount. When the sheet 1 has been conveyed by the predetermined amount (S5, YES), the CPU 201 rotates the driving motor 33 backward to rotate the shaft member 43 and thus the rotating cam 42, thus pivoting the arm member 4 away from the outer periphery of the rolled sheet R (S6). This cancels the contact state between each of the bearing rotators and the rolled sheet R. Furthermore, the CPU 201 controls the separation motor not shown in the drawings to separate the nip roller 11 from the conveying roller 10 to reduce the nip force exerted by the nip roller 11 (S6). Then, the CPU 201 controls the spool driving motor 34 and the driving motor 35 to repeat conveyance and rewinding of the sheet 1 (S7). While the sheet 1 is being taken up, the position of end of the sheet 1 is read using a sensor not shown in the drawings to allow the amount of positional deviation to be detected. The CPU 201 determines whether not the positional deviation of the sheet 1 has been corrected based on the information from the sensor not shown in the drawings (S8). When the positional deviation of the sheet 1 has been corrected (S8, YES), the CPU 201 ends the positional-deviation correcting operation. When the positional deviation of the sheet 1 has not been corrected (S8, NO), the CPU 201 allows the positional-deviation correcting operation to be continued until the positional deviation is corrected.

Upon determining that the positional deviation of the sheet 1 has been corrected (S8, YES), the CPU 201 determines whether or not the leading end of the sheet 1 has been detected by the leading end detecting sensor 12 (S9). When the leading end of the sheet 1 has not been detected (S9, NO), the CPU 201 controls the driving motor 35 to rewind the sheet 1 until the leading end of the sheet 1 has been detected by the leading end detecting sensor 12. When the leading end of the sheet 1 has been detected (S9, YES), the CPU 201 controls the spool driving motor 34 and the driving motor 35 to stop rotation of the spool driving gear 30 and the conveying roller 10, thus stopping the operation of rewinding the sheet 1.

The CPU 201 controls the separation motor not shown in the drawings to move the nip roller 11 in a direction in which the nip roller 11 approaches the conveying roller 10, thus returning the nip force exerted by the nip roller 11 to the value obtained before the positional-deviation correcting operation (S10). The CPU 201 thus ends the present process. After the present process ends, a print operation is started as needed. As described above, the leading end of the sheet 1 is set at the position where the leading end lies before the start of the print operation, through the operation of feeding the leading end of the sheet 1 from the roll portion of the rolled sheet R and the operation of correcting the positional deviation of the sheet 1.

When the CPU 201 receives an instruction to start the print operation, processing similar to the processing in S1 to S4 described above is executed. Thus, with the bearing rotators held in contact with the outer periphery of the rolled sheet R from below in the direction of gravity, the rolled sheet R is rotated to allow the sheet 1 to be fed from the rolled sheet R. The print head 15 performs a printing operation to print an image on the fed sheet, and the sheet with the image printed thereon is output. Thus, in this case, the rolled sheet R is set in the print apparatus 100, and the bearing rotators are placed at the contact position when the sheet 1 is pulled out from the rolled sheet R, at the separate position for positional deviation correction, and at the contact position again after the positional deviation correction. In the operation of conveying the sheet during the print operation, the bearing rotators need not come into contact with the rolled sheet R.

Furthermore, with reference to FIG. 6, the case has been described where, in the positional-deviation correcting operation, the sheet 1 is conveyed by the predetermined amount so as to prevent the leading end of the sheet 1 from being positioned on the upstream side of the position of the conveying roller 10 and the nip roller 11 in the y direction. However, during the positional-deviation correcting operation, the leading end of the sheet 1 may be positioned on the upstream side of the position of the conveying roller 10 and the nip roller 11 in the y direction, depending on the amount of positional deviation of the sheet 1. In this case, when the sheet 1 is fed, the bearing rotators may be brought into again contact with the outer periphery of the rolled sheet R for sheet feeding.

In this case, the rolled sheet R is rotated and the bearing rotators are brought into contact with the outer periphery of the rolled sheet R so as to rotate in conjunction with rotation of the rolled sheet R. Thus, for sheet feeding, a sheet feeding force (the force with which the sheet is fed out from the roll portion of the rolled sheet) is applied to the rolled sheet R. The amount of the force needed for sheet feeding depends on resistance offered during sheet feeding, and the amount of the resistance depends on various conditions such as the type of the sheet and the structure of conveying path. For example, a sheet with a relatively high rigidity needs a stronger sheet feeding force than a sheet with a lower rigidity. A sheet with a relatively heavy basis weight needs a stronger sheet feeding force than a sheet with a lighter basis weight. When the conveying path is complicated or long, high resistance is offered during sheet feeding, resulting in the need for a relatively strong sheet feeding force.

Furthermore, in this case, since the plurality of bearing rotators is arranged in the x direction, the bearing rotators contact the sheet at more positions when the sheet has a relatively large width (the width in the x direction) than when a sheet with a smaller width is conveyed. Thus, the sheet may be damaged depending on the type of the sheet or the degree of the contact force.

Thus, in this case, the force with which the bearing rotators come into contact with the outer periphery of the rolled sheet R is changed depending on the type of the sheet 1 to exert a contact force suitable for each type of sheet. Thus, a sheet feeding force resulting from the contact force is applied to the rolled sheet R to feed the sheet 1.

FIG. 8 is a table depicting an example of a table used to specify the positions of the bearing rotators. FIG. 8 depicts contact forces exerted during sheet feeding and which are suitable for the respective types of sheets. In the case depicted in FIG. 8, a standard contact force is a contact force suitable for sheet feeding when the type of the sheet is plain paper, glossy paper, or coated paper. In contrast, a contact force exerted when the sheet type is paper susceptible to damage, for example, thin paper, is set weaker than the standard contact force. A contact force exerted when the sheet type is paper with relatively high rigidity or a relatively heavy basis weight, for example, art paper, is set stronger than the standard contact force.

The position specifying unit 38 uses the table depicted in FIG. 8 to determine the contact position so as to allow exertion of a contact force according to the sheet type received from the CPU 201. The position specifying unit 38 then transmits information on the contact position to the CPU 201.

As described above, the CPU 201 controls the driving motor 33 based on the information received from the position specifying unit 38 and the measurement result from the distance sensor 5*c*. In other words, the CPU 201 controls the driving motor 33 as needed to rotate the shaft member 43 to rotate the rotating cam 42 in conjunction with rotation of the shaft member 43. Thus, the positions of the bearing rotators are changed to change the contact force exerted on the rolled sheet R by the bearing rotators. Specifically, when the sheet is susceptible to damage, the bearing rotators are brought into contact with the rolled sheet R with a contact force weaker than the standard contact force to apply a sheet feeding force to the sheet for sheet feeding while suppressing possible damage to the print surface of the sheet. On the other hand, for example, when the sheet has high rigidity, the bearing rotators are brought into contact with the rolled sheet R with a contact force stronger than the standard contact force to apply a relatively strong sheet feeding force to the sheet for sheet feeding. This allows the sheet 1 to be adequately fed from the roll portion of the rolled sheet R.

The case has been described where the table depicted in FIG. 8 is used in which the sheet types are associated with the contact forces. However, the contact force may be determined using another condition. For example, it is also preferable to use a table in which sheet sizes are associated with contact forces, a table in which sheet types and sizes are associated with contact forces, or a table in which various setting conditions are associated with contact forces. Furthermore, the characteristics of the sheet may change depending on an environmental condition (temperature or humidity) in the sheet feeding apparatus or the print apparatus. Thus, the contact may be changed taking the environmental condition in the apparatus into account.

As described above, the rolled sheet R is rotated, and the bearing rotators are held in contact with the outer periphery of the rolled sheet R from below in the direction of gravity. The bearing rotators are then rotated to apply a sheet feeding force to the rolled sheet so as to set the force with which the sheet 1 is fed stronger than the resistance offered at the same time. This suppresses possible deflection or the like of the sheet 1 caused by the weight of the sheet 1 when the sheet 1 is fed out, allowing the sheet 1 to be appropriately fed out from the roll portion.

Upon coming into contact with the rolled sheet R, the bearing rotators (driven rotator 6 and driven rotator 7) are driven to rotate in conjunction with rotation of the rolled sheet R. Thus, the bearing rotators are prevented from hindering the rotation of the rolled sheet R and enable suppression of possible damage to the portion of the rolled sheet R which contacts the bearing rotators. Furthermore, the bearing rotators are held in contact with the outer periphery of the rotating rolled sheet R to transmit the driving force that rotates the rolled sheet R to the bearing rotators via the frictional force between sheets in the roll portion. This increases the sheet feeding force exerted by the bearing rotators.

Since the plurality of bearing rotators is arranged along the x direction, the sheet feeding force from the bearing rotators can be efficiently applied to the rolled sheet R. In the sheet feeding operation, the bearing rotators are held in contact with the rolled sheet R from below in the direction of gravity (from below to above) to assist bearing of the weight of the rolled sheet R, thus reducing deflection (roll deformation) of the rolled sheet R caused by the weight thereof. Furthermore, since the bearing rotators bear a part of the weight of the rolled sheet R, a force is reduced which is exerted on components such as flanges or spools which bear the sheet at the opposite ends of the rolled sheet R. Thus, bearing accuracy and component fatigue are reduced. As a result, high sheet feeding accuracy can be maintained over long use. Additionally, since the bearing rotators rotate during sheet feeding as described above, the sheet surface suffers no dragging damage, leading to high-quality printing.

The bearing rotators are configured to be movable and can thus be placed at the contact position in order to apply a sheet feeding force to the rolled sheet R during the sheet feeding operation and at the separate position in order to perform an operation of rewinding the sheet 1 or the like. Thus, during the rewind operation, the bearing rotators are prevented from hindering the operation.

Second Embodiment

Figure 9:
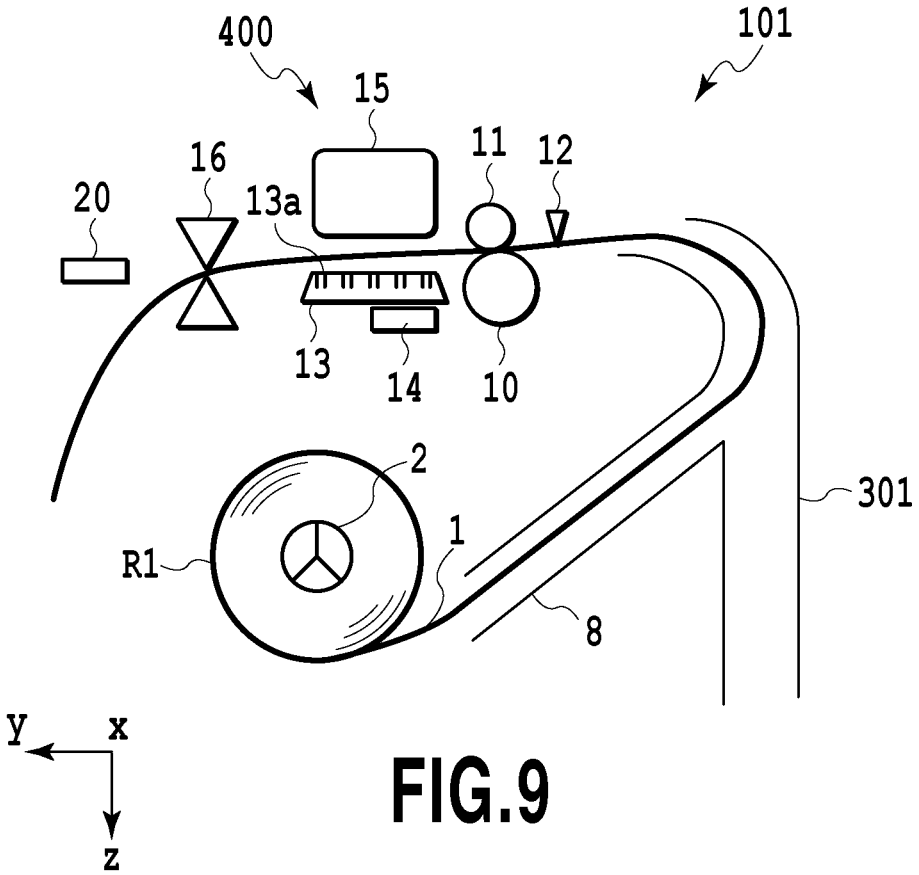
FIG. 9 is a schematic cross-sectional view depicting an internal configuration of a print apparatus of a second embodiment.
Figure 10:
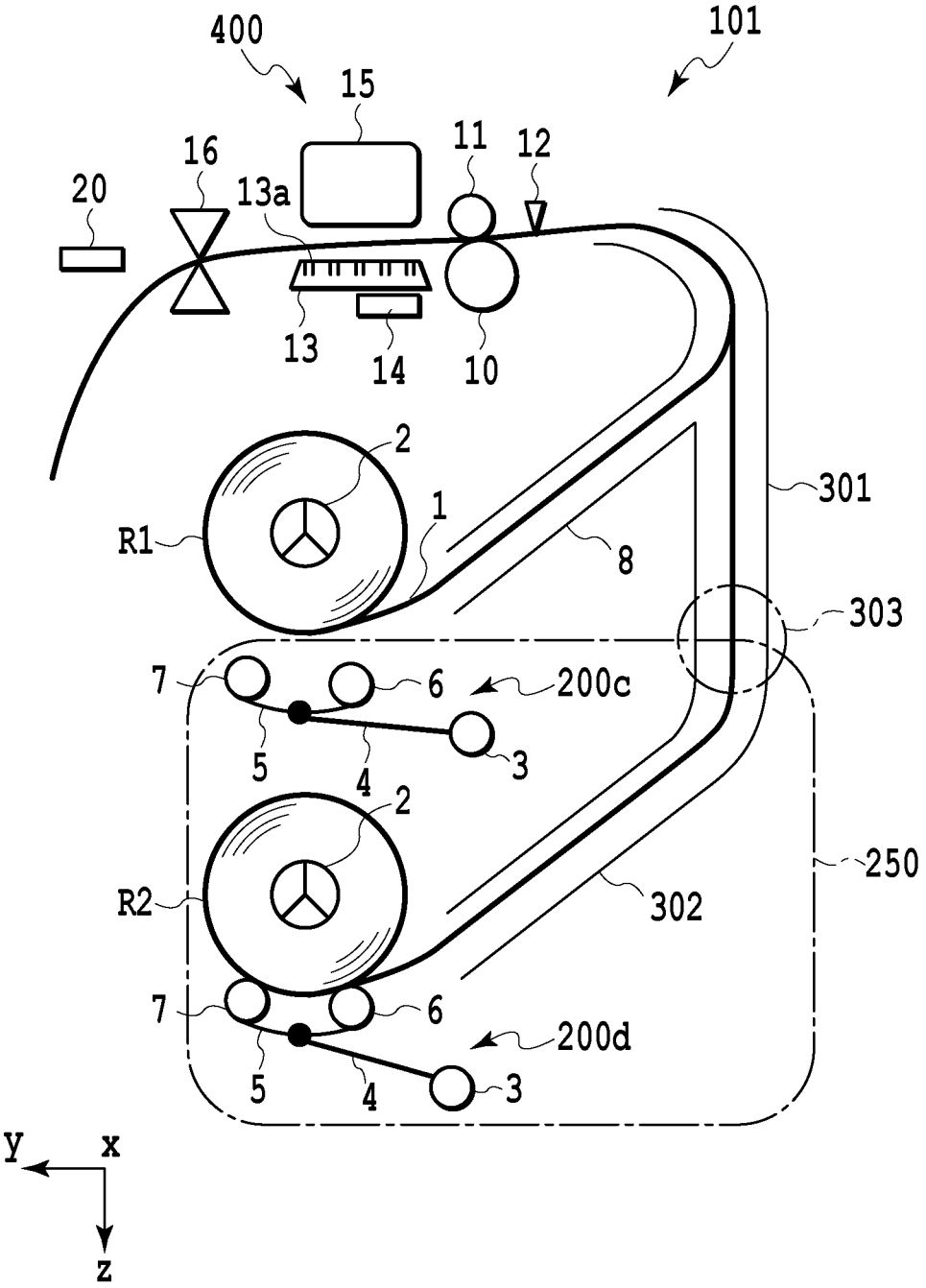
FIG. 10 is a schematic cross-sectional view depicting the internal configuration of the print apparatus of the second embodiment.

FIG. 9 and FIG. 10 are schematic cross-sectional views depicting another example of an internal configuration of a print apparatus 101. In the present embodiment, a case will be described where a sheet feeding apparatus is attached to a print apparatus with no sheet feeding unit. As described above with reference to FIG. 2, the print apparatus 100 has been described which has the two sheet feeding units (200*a* and 200*b*) so as to enable feeding from two rolls of sheets R. However, a feeding apparatus may be arranged as needed in such a print apparatus 101 with no sheet feeding unit. Components in FIG. 9 and FIG. 10 which are similar to the corresponding components of the above-described embodiment will not be described.

As shown in FIG. 9, the print apparatus 100 has no sheet feeding unit, and has one rolled sheet R1 set therein. Furthermore, the print apparatus 101 does not have the spool driving gear 30 or the spool driving motor 34. Thus, in the print apparatus 101, after the user sets a rolled sheet R1 in the print apparatus 100, the rolled sheet R1 is rotated counterclockwise in a front view to guide a sheet 1 to a conveying guide 8. The user rotates the rolled sheet R1 until the leading end of the sheet 1 reaches the readable range of a leading end detecting sensor 12. When the leading end detecting sensor 12 detects the leading end of the sheet 1, processing similar to the processing in S4 and the subsequent steps depicted in FIG. 6 is executed. When an option unit 250 including sheet feeding apparatuses 200*c* and 200*d* is mounted in the print apparatus 101, a configuration depicted in FIG. 10 is obtained.

FIG. 10 depicts that the option unit 250 is mounted in the print apparatus 101 depicted in FIG. 9. As shown in FIG. 10, the option unit 250 has sheet feeding apparatuses 200*c* and 200*d* and a conveying path 302. A conveying path 301 in the print apparatus 101 and the conveying path 302 in the option unit 250 are connected together via a connection portion 303.

As shown in FIG. 10, when the option unit 250 is mounted in the print apparatus 100, the sheet feeding apparatus 200*c* is positioned so as to be able to come into contact with the rolled sheet R set in the print apparatus 101. Although not shown in the drawings, the sheet feeding apparatus 200*c* has a spool driving gear 30 and a spool driving motor 34. The spool driving motor 34 rotates the spool driving gear 30 and rotation of the spool driving gear 30 is transmitted to a spool rotating gear 25 of a spool 2 to drive and rotate a spool shaft 21 integrated with the rolled sheet R. Thus, the leading end of the sheet 1 can be fed out from the roll portion of the rolled sheet R1 by means of a sheet feeding operation similar to the sheet feeding operation in the above-described embodiment without the need for the user to perform an operation of rotating the rolled sheet R. Furthermore, the sheet feeding apparatus 200*d* with a rolled sheet R2 set therein is arranged further below the sheet feeding apparatus 200*c* in the z direction. Consequently, the print apparatus 101 that is an inexpensive one-roll machine with a simple configuration can be used as a two-roll machine.

As described above, the sheet feeding apparatus is mounted in the print apparatus with no sheet feeding unit as an option unit to enable a reduction in the user's burden during the sheet feeding operation. Moreover, the sheet feeding apparatus with the rolled sheet set therein is mounted in the print apparatus to enable an increase in the number of rolled sheet that can be used for the print apparatus.

Third Embodiment

In the present embodiment, a configuration will be described in which a first rotary encoder 36 is attached to a spool driving motor 34 and in which a second rotary encoder 37 is attached to a driving motor 35. In the above-described embodiments, the driving motor 33 is controlled based on the measurement result from the distance sensor 5*c*. However, in the present embodiment, the driving motor 33 is controlled based on detection values from the encoders. A method will hereinafter be described in which bearing rotators are brought into contact with an outer periphery of a rolled sheet R in an operation of feeding a sheet 1 after the sheet 1 is sandwiched between a conveying roller 10 and a nip roller 11. Furthermore, a case will be described where the positional-deviation correcting operation described in the first embodiment is not performed. Components similar to the corresponding components in the first embodiment will not be described.

Figure 11:
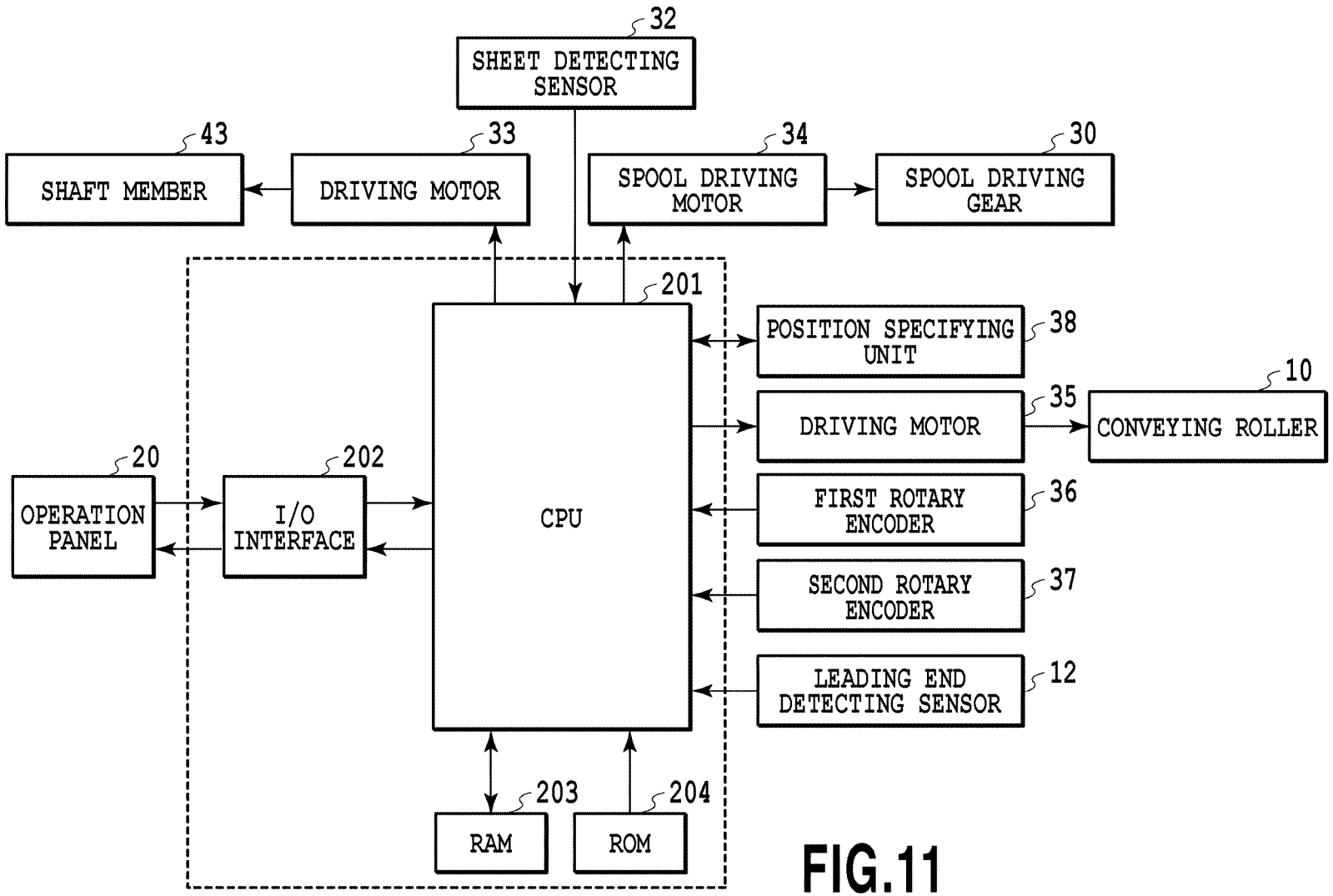
FIG. 11 is a block diagram depicting a control configuration in the print apparatus of a third embodiment.

FIG. 11 is a block diagram depicting a control configuration in a print apparatus 100. As depicted in FIG. 11, instead of the distance sensor 5*c* depicted in FIG. 5, the first rotary encoder 36 and the second rotary encoder 37 are connected to a CPU 201. The first rotary encoder 36 detects the rotation amount (the rotation angle or the number of rotations) of the spool driving motor 34. The second rotary encoder 37 detects the rotation amount of the driving motor 35.

After setting the rolled sheet in the print apparatus 100, the user rotates the rolled sheet R1 until the leading end of the sheet 1 reaches the readable range of a leading end detecting sensor 12. When the leading end detecting sensor 12 detects the leading end of the sheet 1, the CPU 201 rotates the conveying roller 10 via the driving motor 35. Thus, the sheet 1 is sandwiched between the conveying roller 10 and the nip roller 11.

The CPU 201 compares detection values obtained from the encoders when the tensed sheet 1 is conveyed by a predetermined amount after the sheet 1 is sandwiched between the conveying roller 10 and the nip roller 11, to determine a change in the outer diameter of the rolled sheet R based on the amount by which the sheet 1 has been fed and conveyed. The CPU 201 receives information on the distance between the rolled sheet R and the bearing rotators measured when the rolled sheet R is set. Based on this information and the change in the outer diameter of the rolled sheet R, the CPU 201 determines the current distance between the rolled sheet R and the bearing rotators, and controls the driving motor 33 so as to position the bearing rotators at positions specified by a position specifying unit 38.

As described above, in the present embodiment, a sheet feeding force is applied to the rotating rolled sheet R during the sheet feeding operation after the sheet 1 is sandwiched between the conveying roller 10 and the nip roller 11. Thus, the sheet 1 can be adequately fed from the rolled sheet R and prevented from being deflected during conveyance so as to be stably conveyed. This enables suppression of degradation of image quality in a print operation performed during conveyance.

Other Modifications

In the above-described embodiments, the case has been described where the bearing rotator includes two members, the driven rotator 6 and the driven rotator 7. However, the bearing rotator may be one of the driven rotators 6 and 7 and may be shaped like a rotating belt instead of a roller. Furthermore, the bearing rotator is not limited to the one that rotates in conjunction with motion of the sheet but may actively rotate under a driving force.

Additionally, in the above-described embodiments, the configuration has been described in which the bearing rotators are brought into contact with the outer periphery of rolled sheet R from below in the direction of gravity. However, the configuration may be replaced with a form in which a force is applied to the outer periphery of the rolled sheet R from below in the direction of gravity. For example, a member which does not rotate and which has a smooth surface and is thus unlikely to damage the sheet may be pressed against the outer periphery of the rolled sheet from below. Alternatively, air may be locally blown hard against the outer periphery of the rolled sheet to bear the rolled sheet by means of air pressure. That is, various forms may be adopted as long as deflection of the sheet 1 caused by the weight of the sheet 1 or the like can be suppressed.

In the above-described embodiments, the bearing rotators come into contact with the rolled sheet R from below in the direction of gravity. "From below in the direction of gravity" as used herein is not limited to such a positional relation as shown in FIG. 2. As long as the bearing rotators are positioned to be able to bear, even slightly, the weight of the rolled sheet R, this is interpreted to mean "from below in the direction of gravity".

The information used to control the positions of the bearing rotators may be acquired using the distance sensor described in the first embodiment or the encoders described in the third embodiment. That is, as long as the positions of the bearing rotators can be controlled, a method for acquiring the information used for the control is not particularly limited.

In the above-described embodiments, the case has been described where the two feeding apparatuses corresponding to the respective, two rolls of sheets are arranged in the print apparatus. However, the number of feeding apparatuses may be changed as needed in accordance with the number of rolls of sheets R set in the print apparatus. In other words, the print apparatus may include two or more feeding apparatuses or only one feeding apparatus.

In the above-described embodiments, the case has been described where the feeding apparatuses are arranged in the print apparatus. However, the feeding apparatuses may be arranged in a reading apparatus, a reading print apparatus, or the like. That is, the feeding apparatuses described above in the embodiments may also be used when sheets are fed to a reading unit of a reading apparatus such as a scanner or a print unit or a reading unit of a reading print apparatus such as a copy machine.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-101623, filed May 15, 2014, which is hereby incorporated by reference herein in its entirety.

What is claimed is:

1. A print apparatus comprising:

a holder configured to hold a rolled sheet that is a continuous sheet wound into a roll;

a print head configured to print on the rolled sheet supplied from the holder;

a driving unit configured to rotate the rolled sheet held by the holder and supply the rolled sheet to the print head;

a rotator configured to contact with an outer periphery of the rolled sheet held by the holder and to rotate in conjunction with the rolled sheet; and a moving unit configured to move the rotator between a first position where the rotator is in contact with the outer periphery of the rolled sheet and a second position where the rotator is separate from the outer periphery of the rolled sheet.

2. The print apparatus according to claim 1, wherein spools are attached to respective opposite ends of the rolled sheet and rotatably held by the holder, and the driving unit applies a rotational driving force to at least one of the spools.

3. The print apparatus according to claim 1, wherein the rotator includes a first rotator and a second rotator arranged separately from each other in a direction in which the rolled sheet is fed.

4. The print apparatus according to claim 1, wherein a plurality of the rotators are arranged along a sheet width direction of the rolled sheet.

5. The print apparatus according to claim 1, wherein the moving unit moves the rotator to contact with the outer periphery of the rolled sheet when the rolled sheet is fed, the moving unit moves the rotator to separate from the outer periphery of the rolled sheet when a positional deviation of the sheet is corrected, and the moving unit moves the rotator to contact with the outer periphery of the rolled sheet again after position deviation correction is complete.

6. The print apparatus according to claim 1, wherein the moving unit adjusts a force with which the rotator comes into contact with the outer periphery of the rolled sheet to assist bearing of a weight of the rolled sheet.

7. The print apparatus according to claim 6, wherein the moving unit changes the force in accordance with at least one of a characteristic of the rolled sheet used, a size of the rolled sheet, and an environmental condition.

8. The print apparatus according to claim 6, wherein the moving unit includes an arm, a rotator holder configured to hold the rotator at an end of the arm via an elastic member and a second driving unit configured to pivot the arm, and the moving unit pivots the arm by the second driving unit to adjust a force with which the rotator is separated from the outer periphery of the rolled sheet and the force with which the rotator comes into contact with the outer periphery of the rolled sheet.

9. The print apparatus according to claim 1, further comprising a first supply unit and a second supply unit each comprising the holder and the rotator for sheet feed.

* * * * *